US005567285A

United States Patent [19]

Sitges Menendez et al.

[11] Patent Number: 5,567,285

[45] Date of Patent: Oct. 22, 1996

[54] FACILITY FOR REMOVING ELECTRO-DEPOSITED LAYERS FROM CATHODES

[75] Inventors: Francisco J. Sitges Menendez, Madrid; Fernando Sitges Menendez, Salinas; Francisco Alvarez Tamargo, Luanco; Francisco Tamargo Garcia, Castrillon; Jose M. Quiroga Alvarez, Castrillon; Ives Lefevre, Castrillon; Carlos Gonzalez Gonzalez, Santa Cruz de Llanera, all of Spain

[73] Assignee: Asturiana De Zinc, S.A., Spain

[21] Appl. No.: 455,703

[22] Filed: May 31, 1995

[30] Foreign Application Priority Data

May 31, 1994 [ES] Spain ..... 9401189

[51] Int. Cl.[6] ..... C25D 17/00

[52] U.S. Cl. ..... 204/227; 204/281

[58] Field of Search ..... 204/227, 281, 204/203, 226

[56] References Cited

U.S. PATENT DOCUMENTS

| | | | |
|---|---|---|---|
| 3,808,107 | 4/1974 | Frantzen et al. | 204/203 X |
| 3,883,403 | 5/1975 | Ettel et al. | 204/281 X |
| 3,996,127 | 12/1976 | Rautimo et al. | 204/281 |
| 4,209,379 | 6/1980 | Freeman et al. | 204/281 X |
| 4,566,951 | 1/1986 | Norberg et al. | 204/203 X |

*Primary Examiner*—Donald R. Valentine

*Attorney, Agent, or Firm*—Ostrolenk, Faber, Gerb & Soffen, LLP

[57] ABSTRACT

A facility for removing electro-deposited layers from cathodes, including a cathode reception area, a cathode treatment area with a cathode washing apparatus and an extraction apparatus, and a storage area to store cathodes which have had electro-deposited layers removed. The extraction apparatus includes vertical claws and two parallel rollers mounted so that they are capable of turning freely upon two horizontal parallel bars. The bars are fixed between pairs of arms that are mounted so that they may tilt on a bracket. The bracket also carries upper separating rollers.

20 Claims, 11 Drawing Sheets

1
2
3
4
5
6
7
8
9
10
11
12
13
14
15
16
17
18
19
20
III
II

FACILITY FOR REMOVING ELECTRO-DEPOSITED LAYERS FROM CATHODES

BACKGROUND OF THE INVENTION

The present invention relates to a facility for removing layers that are electro-deposited onto cathodes, and is particularly applicable to the situation where metals, such as copper and zinc, are deposited by electrolysis.

More specifically, the present invention relates to the type of facility that includes an area for the reception of cathodes coming from the electrolytic vats, a cathode treatment area, and a storage area for cathodes free from the electrolytic metal layer. The cathodes may be moved consecutively from one of these areas to the other. The treatment area includes apparatus to wash the cathodes and to remove the electro-deposited metal layers.

Generally, in these types of facilities, the apparatus for washing the cathodes are stationary water jets directed at the cathodes. The operation to remove the electro-deposited metal layers are carried out in two successive operations. In the first operation, the upper edge of the electro-deposited layer is separated from the cathode plate, and in the second operation the cathode plates are totally separated from the electro-deposited layers.

In a known facility for the electrolytic deposition of zinc, a penetrator is used in the first operation to separate the upper edge of the electro-deposited layer from the cathode plate, and in the second operation are used to totally remove the electro-deposited layer from the cathode. A facility of this type is described, for example, in Spanish Patent No. 2020729 by the applicants of the present invention.

The electrolytic deposition of copper is described in Spanish Patent No. 2005573, of MIM Technology Marketing Ltd. In the procedure of that patent, the first stage of separation proceeds by subjecting the cathode to bending so as to enable at least part of the electro-deposited metal layer to separate from the cathode. In the following stage the electro-deposited layer is completely removed by the use of claws or gas jets.

Whichever may be the system selected, the complete removal of the electro-deposited metal layer from the cathode requires two successive operations. These operations and the facilities for performing these operations are very costly because of the equipment required.

In additions, in these procedures which involve the bending of the cathode in the first stage, there is a risk of causing the protection on the edges of the cathode from separating from the cathode. This may result in the entry of fluid between the protection and cathode during the electrolytic process, which results in the deposition of metal in these areas of the cathode.

SUMMARY OF THE INVENTION

An object of the present invention is to overcome the disadvantage of previously known facility for removal of electro-deposited metal layers on cathodes. Another object of the facility of the present invention is to effect the separation of electro-deposited deposited metal layers from a cathode, by a continuous process involving one stage or operation and requiring the use of only one extraction unit.

A further object of the present invention is a facility that allows the full separation of the electro-deposited metal layers from cathode plates without damaging the cathode plate or the protection on its edges.

Still another object of the facility of the invention is to provide a facility that is an improvement on conventional facilities.

In the facility of the present invention, the washing and extraction apparatus includes a number of independent brackets, each of which has a vertical passage sized to limit the passage of a cathode. Each bracket is fitted upon a gantry capable of vertical movement between a lower position in which it is placed below the lower edge of the cathode and an upper position in which the bracket contacts the cathode.

A washing station bracket used in the present invention is configured as a drawer and has the means necessary to spray pressurized water upon the cathode surface.

A extraction station bracket used in the present invention includes two sets of vertical claws that are set so that they may turn freely upon two horizontal parallel bars, each of which is set between end arms articulated by their lower end to the upper end of the bracket. The extraction station also includes two rollers, each of which is mounted coaxially and is capable of turning freely on one of the aforementioned bars, between the claws of the bar. These arms may oscillate between maximum separation and approximation positions. The bracket may move vertically between a lower position, in which it is located below the lower edge of the cathode placed in the extraction unit, and in a upper position in which the bracket contacts the cathode. The claws are located immediately above the upper edge of the electro-deposited metal layers.

The claws include a wedge-shaped vertical section. These claws are furthermore capable of tilting between a cathode approximation position in which the internal surface of the wedge-shaped areas is parallel to the cathode plate, and a separation position in which the internal surface comes off the cathode plate. Both the claws and the tilting arms are actuated by pneumatic cylinders.

The internal surface of the wedge shaped area of the claws ends up close to the cathode plate without leaning thereon, whenever the bracket is at its upper limiting position and the tilting arms are towards the maximum bar approximation position and the claws tilt towards the cathode maximum approximation position.

The extraction apparatus also includes two upper rollers, parallel to the bars on which the claws are set. The rollers are located above the claws. The rollers are mounted so that they are capable of turning freely between pairs of arms articulated by their lower end to the bracket. The arms are connected to actuating cylinders and may tilt between two limiting positions, one of which is vertical, in which the rollers end up being located outside the bracket vertical passage, and the other position is converging, in which its rollers end up being located towards the inside of the passage.

Other features and advantages of the present invention will become apparent from the following description of the invention which refers to the accompanying drawings.

BRIEF DESCRIPTION OF THE DRAWING(S)

DETAILED DESCRIPTION OF THE INVENTION

Figures 1, 2:
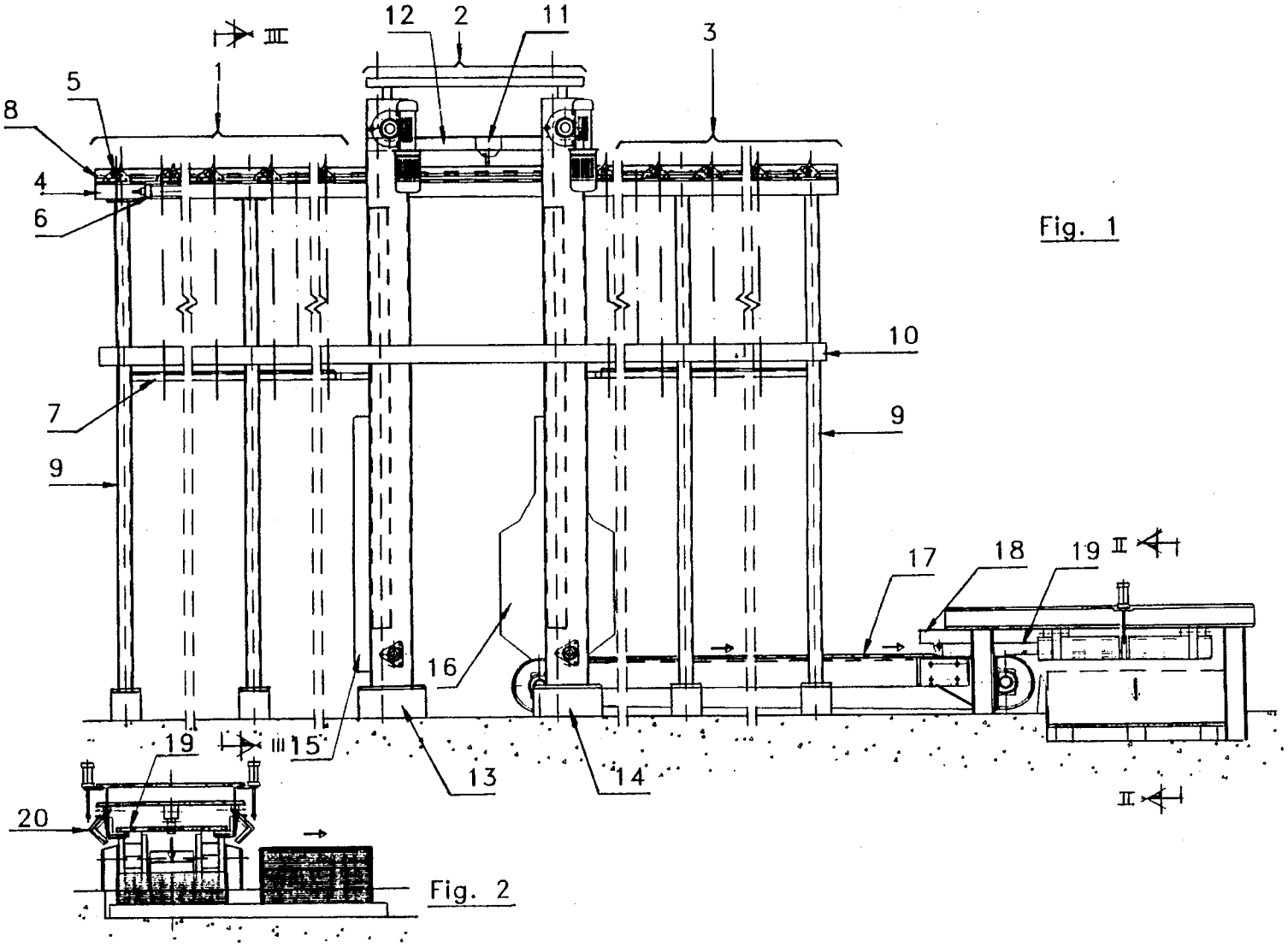
FIG. 1 is a side elevational view of an installation in accordance with the invention.
FIG. 2 is a vertical sectional view of the installation of FIG. 1 taken along the line II—II.
Figure 3:
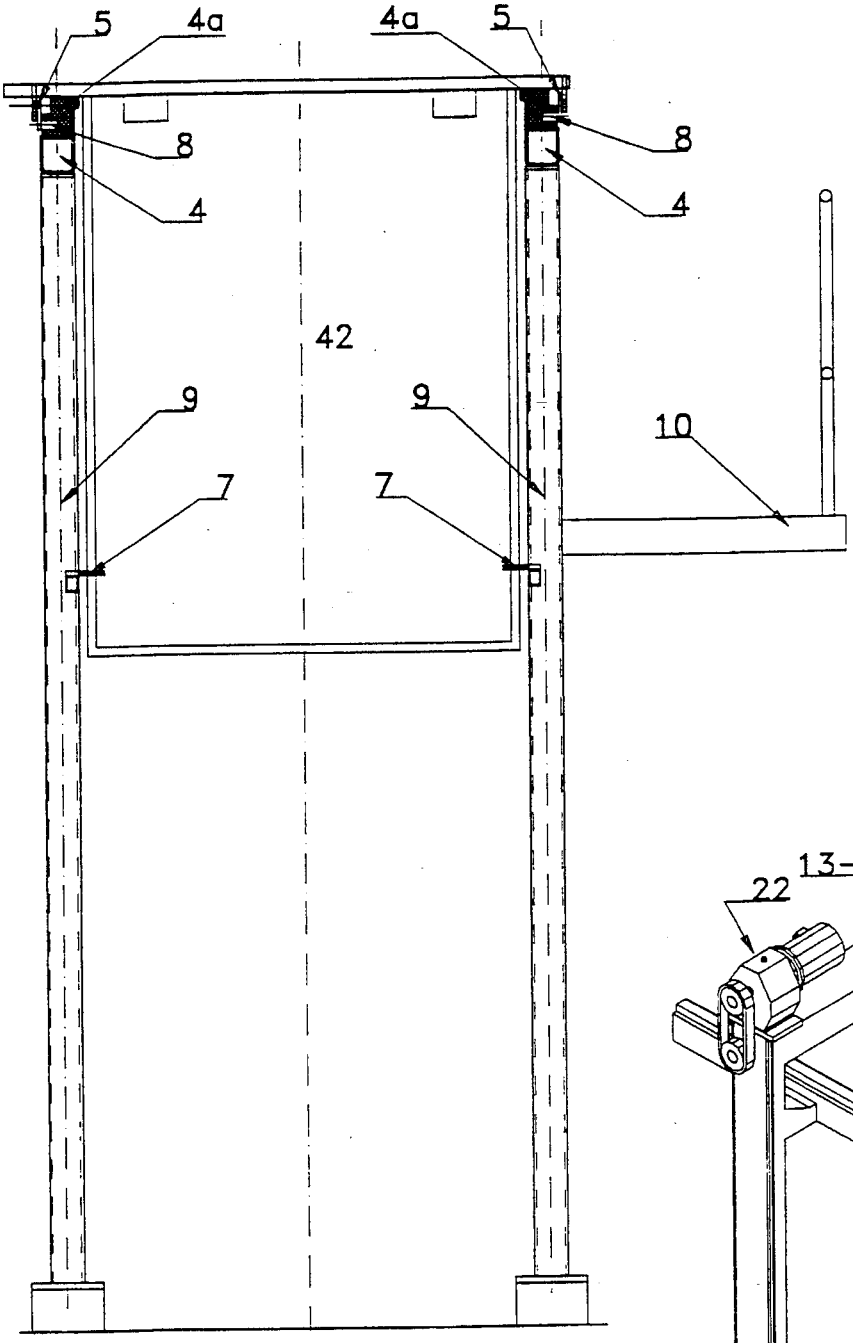
FIG. 3 is a vertical sectional view of the installation of FIG. 1 taken along the line III—III.

The facility shown in FIG. 1 to 3 includes a reception area for cathodes coming from the electrolytic vats, generally designated by the numeral 1, a cathode treatment area 2, and a storage area designated 3 for cathodes which have had the electro-deposited metal layer removed.

Along the upper portion of these three areas extends two parallel metal beams 4 upon which is fixed at its upper portion a plastic profile covering 4*a*, which defines a support and slide surface of a cathode head bar. Both in the cathode reception area 1 and in the storage area 3, cathode positioning and driving elements 5, are arranged above the beams 4 with an actuation system that may include a pneumatic cylinder 6. These two areas also include intermediate tops 7 which prevent any swinging of the cathodes suspended from the beams 4. The cathode positioning and driving elements 5 are set upon profiles 8 supported upon beams 4.

The beams 4 are supported by vertical columns 9 along which extends a gangway 1- which is located above the floor surface.

The cathode treatment area 2 includes a cathode moving and positioning element 11, whereby the cathodes may be taken along a beam 12 located above the beams 4. Furthermore, the cathode treatment area 2 also includes two gantries, designated by reference numerals 13 and 14. The gantry 13 carries the washing apparatus 15, and gantry 14 carries the extraction apparatus 16.

a conveyor belt 17 operates along the lower side of the storage area 3. The electro-deposited metal layers after having been taken off the cathodes, fall onto conveyor belt 17 from an hydraulic dampening device. A pushing mechanism 18 is disposed at the end portion of conveyor belt 17, and comprises a pneumatic cylinder that moves the extracted metal plates 19 on L-shaped guises 20 which guide the plates 19 into piles, as shown in FIGS. 1 and 2.

Figure 4:
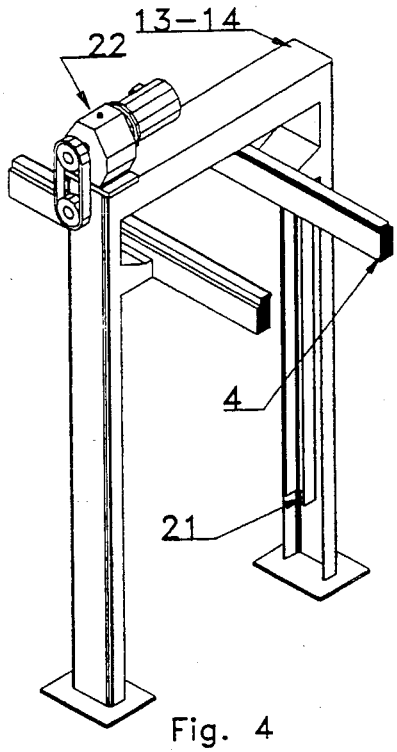
FIG. 4 is a perspective view of one of the gantries of the installation of FIG. 1.

FIG. 4 shows one of the gantries 13 or 14, through which extends beams 4 which support the cathode heads. The footings of the gantries 13 and 14 include guides 21 along which move the washing apparatus 15 or extraction apparatus 16. The gantries 13 and 14 each carry a driving system 22 for the vertical movement of the washing apparatus 15 and extraction apparatus 16.

Figure 5:
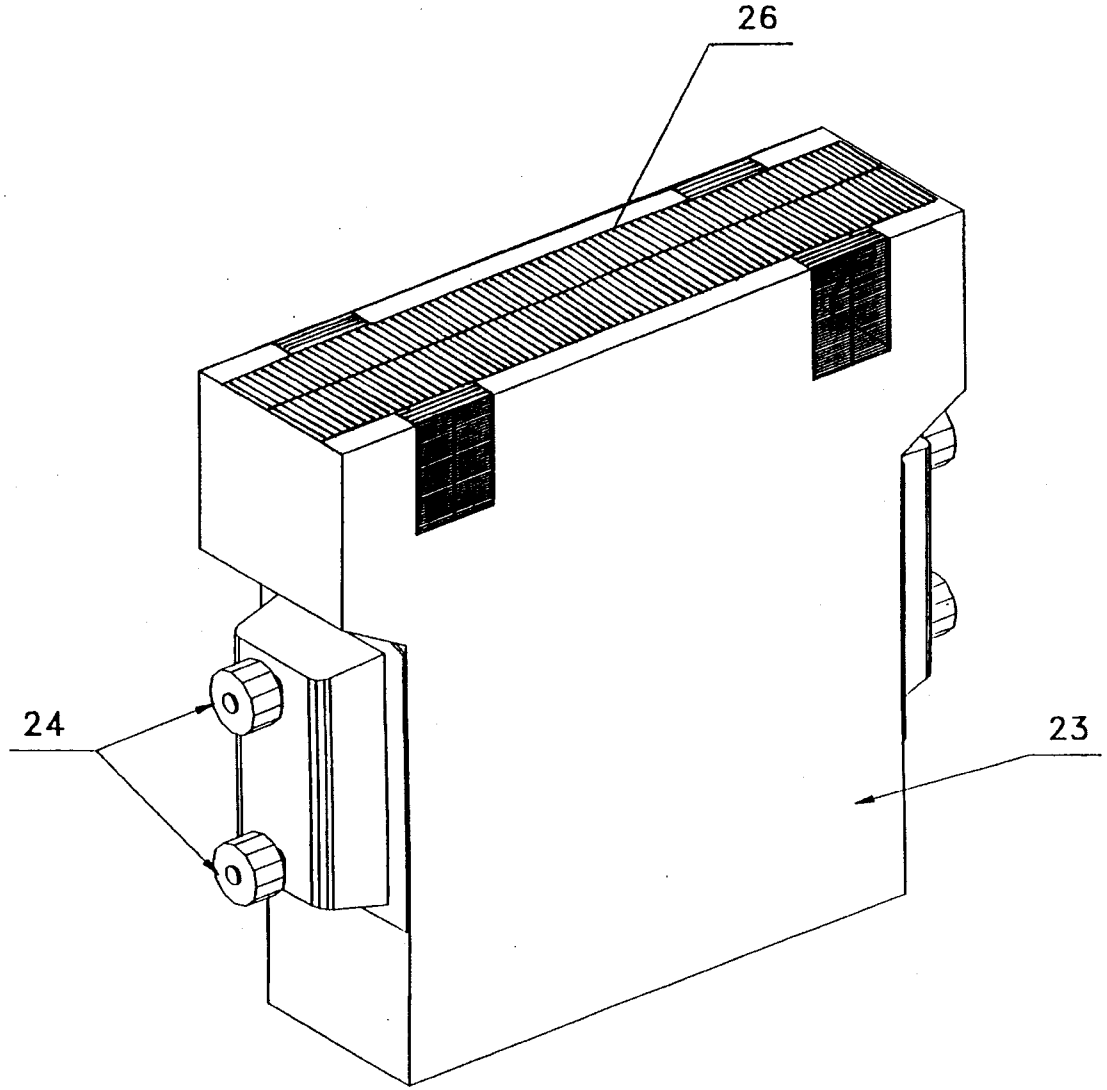
FIG. 5 is a perspective view of a washing chamber.
Figure 7:
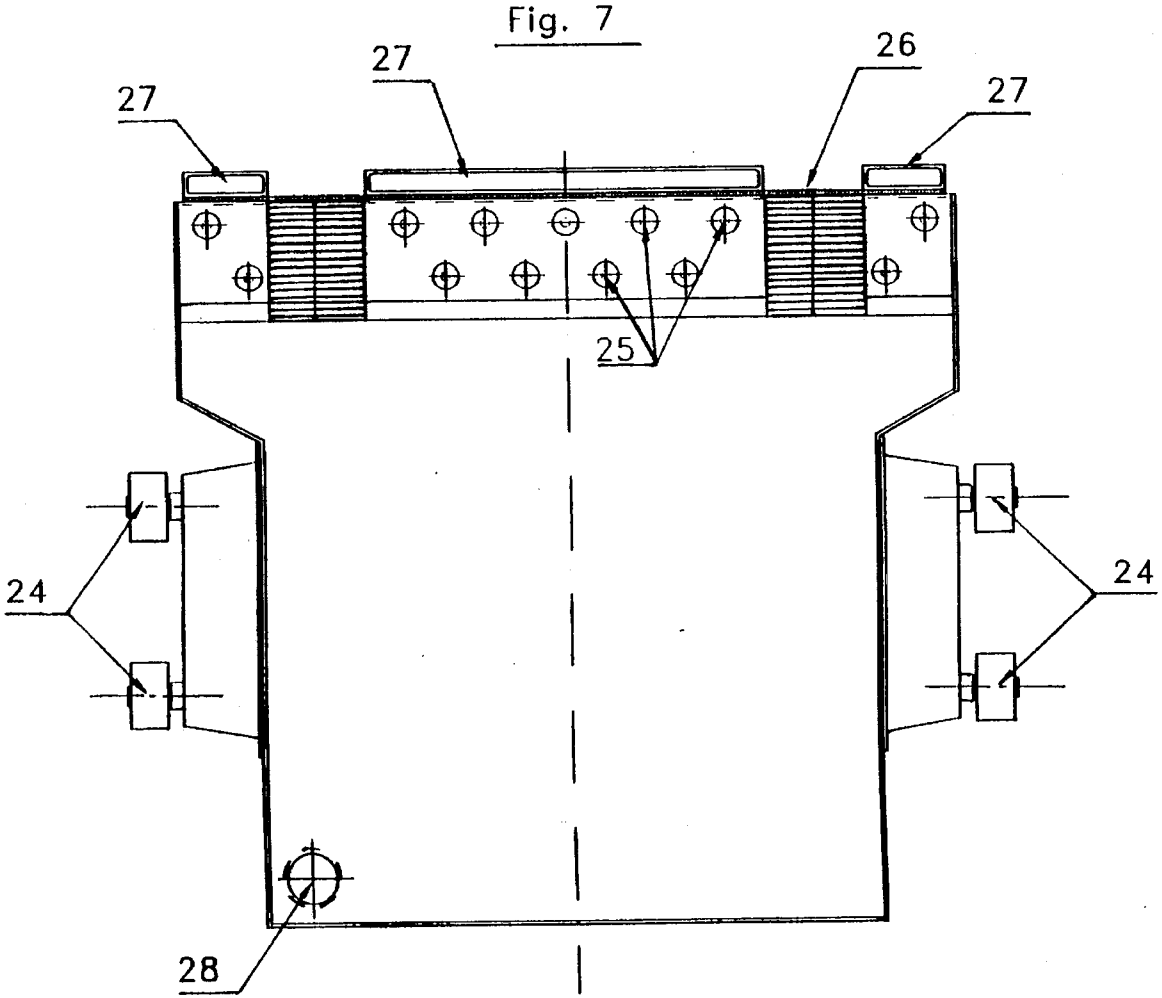
FIG. 7 is a front cross-section view of the washing chamber of FIG. 5.

FIGS. 5 and 7 show the washing apparatus 15, which includes a chamber 23, of a generally rectangular shape and open at its upper end so as to receive and house a cathode. The chamber 23 has at its sides plastic wheels 24, with sealed ball bearings, to guide the chamber 23 along the guide 21 of the gantries, see FIG. 3. Attached to wheels 24 are linear displacement elements of the driving system 22, which also extend along the guides 21.

Figure 6:
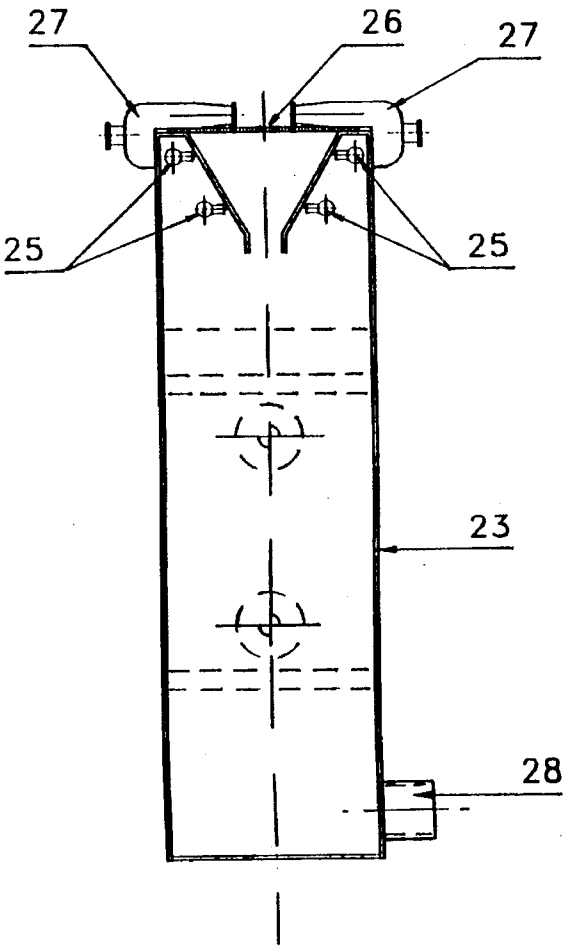
FIG. 6 is a side cross-sectional view of the washing chamber of FIG. 5.

As shown in FIGS. 6 and 7, the washing chamber 23 has internally mounted, along its front and rear walls, two rows of spraying nozzles 25. Spray nozzles 25 are mounted to the walls so that they can change the angle upon which they project a hot water stream on the cathodes introduced into the chamber 23. The opening on the top of chamber 23 is fitted with a system of flexible closing sheets 26 that allow the entry of the cathode plates and prevent the exit of water from inside the chamber 23 This closing mechanism of washing apparatus 15 may comprise a curtain of very flexible plastic threads. Water is fed to the chamber 23 by flexible hoses, and the chamber 23 also includes a steam extraction system 27 connected at its upper portion to suction slots. Chamber 23 further includes pipes 28 to empty the cleaning water.

Figures 8, 9:
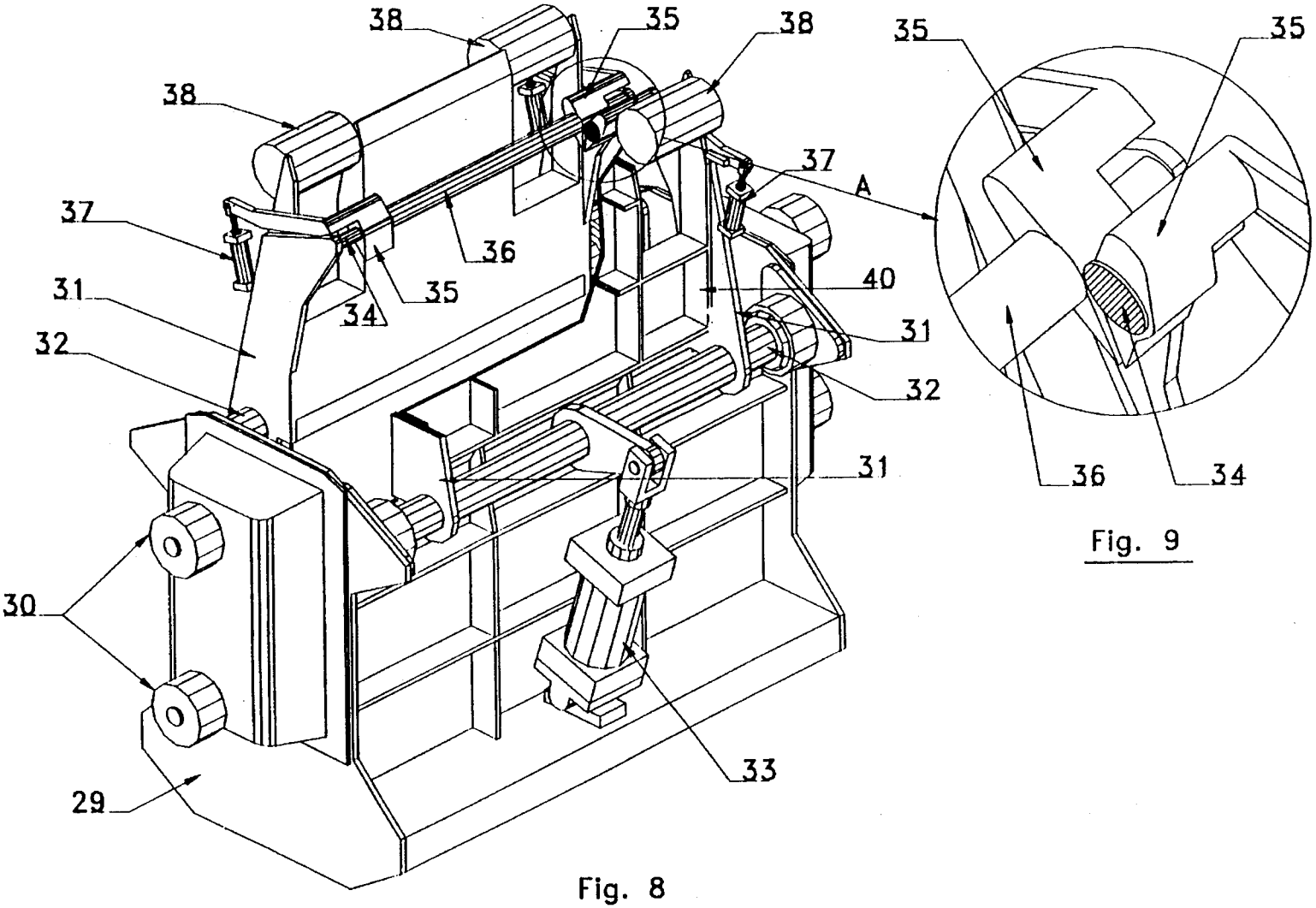
FIG. 8 is a perspective view of the bracket and extraction apparatus.
FIG. 9 is an enlarged view of detail A of FIG. 7.

FIG. 8 and 9 illustrate the extraction apparatus 16, which includes a bracket 29 defining a vertical passage dimensioned to encompass a cathode, and a guiding mechanism with plastic wheels 30 of the same construction and function as the wheels 24 described with respect to the washing chamber 23.

On the upper side of the bracket 29 are positioned, on each side of the vertical passage, two arms 31 that pivot about a turning axis 32. The rotation of axis 32 is controlled by a pneumatic cylinder 33. Between the arms 31 and extending from each arm 31 is a bar 34 parallel to axis 32. On each bar 34 are disposed, so that they may freely turn, two vertical claws 35 and a central coaxial roller 36, which functions as a separation element for the claws 35. The roller 36 has a side surface which sticks out beyond the claws 35 at the side aimed towards the opposite roller. The claws 35 may tilt about bar 34, and is actuated by the hydraulic cylinders 37.

Figure 10:
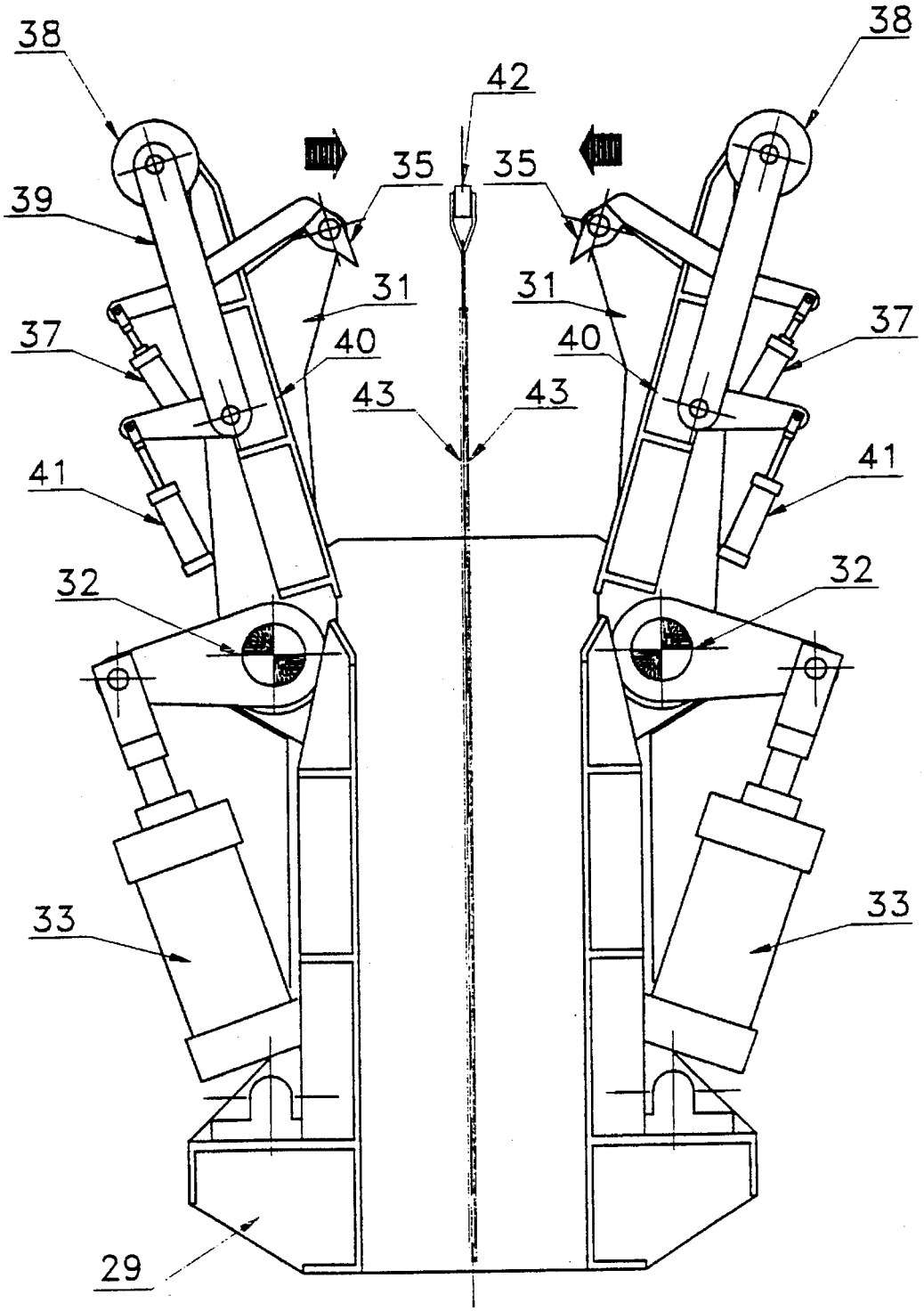
FIG. 10 is a side cross-sectional view of the extraction bracket, showing the various elements or components in non-operating position.

The bracket 29 also includes free turning upper roller 38, mounted upon the upper end of arms 39, see FIG. 10. The arms 39 are pivotable at their lower end to panels 40 which extend between the arms 31, and are pivotable by actuation of the hydraulic cylinders 41.

During the operation of the facility of the present invention, a plurality of cathodes, spaced at an equal distance apart, are carried by a crane bridge, for example, and are positioned upon the beams 4 in the reception area 1. Once the cathodes are properly supported upon the beams 8, the first cathode is moved using the cathode positioning and driving element 5 to a position coincidence with the gantry 13. Hot water feeding is then activated through the nozzles 25 of the washing chamber 23 and the chamber 23 is moved up and down through guides 21 so that a water spray from washing chamber 23 uniformly, and at a constant pressure, covers the surfaces of the cathode. This action ensuring uniform and total cleaning of the cathode. The arrangement and orientation of the nozzles 25 is such that the cathode ends up being fully cleaned, including its header.

When washing chamber 23 reaches its lower limiting position, the cathode is transferred to the second gantry 14, by action of the cathode moving and positioning element 1 . At that time the bracket 29 starts to rise, guided by the rollers 30 and with the arms 31 and 39 in their open position, as shown in FIG. 10. During this operation, the cathode 42 is introduced into the bracket 29 when the bracket 29 reaches its upper limiting position. At this point, the claws 35 are located above the upper edge of the electro-deposited metal layers 43 of cathode 42. From that moment on, the cylinders 33 are activated so that the arms 31 and panels 40 occupy the position shown in FIG. 11. At this point, the claws 35 are near the cathode 42 and the rollers 36 are supported upon the plate of the cathode 42, immediately above the upper edge of the electro-deposited layers 43.

Figure 12:
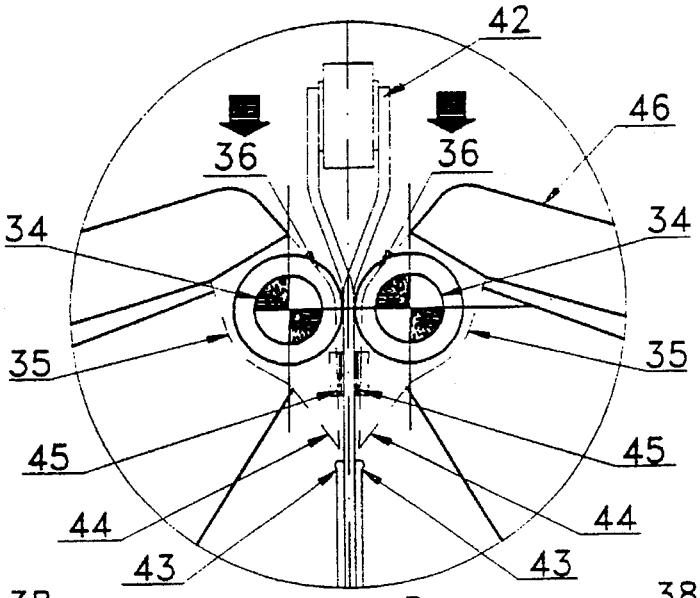
FIG. 12 is an enlarged view of detail B of FIG. 10.

As may be observed in FIG. 12, the claws 35 include a wedge shaped section 44, having an angled edge parallel to the cathode plate 42. In the initial working position, shown in FIGS. 11 and 12, the internal surface of the wedge shaped section 44 is parallel to the cathode plate 42 and is slightly separate from it. In order to avoid any risk of metal contact between the claw 35 and the cathode plate 42, the claws 35 may include with a plastic protection device 45. The angled edge of the section 44 is subjected to an anti-wear treatment, to enable the angled edge to withstand a high number of working cycles without showing any appreciable wear.

The positioning of the rollers 36, as shown in FIG. 12, ensures the correct positioning of both of the cathode and of the claws 35 with respect to it. The distance between the angled edge of the electro-deposited layers 44 may be adjusted by regulating the position of the plate 46 which supports the claw 35.

Figure 11:
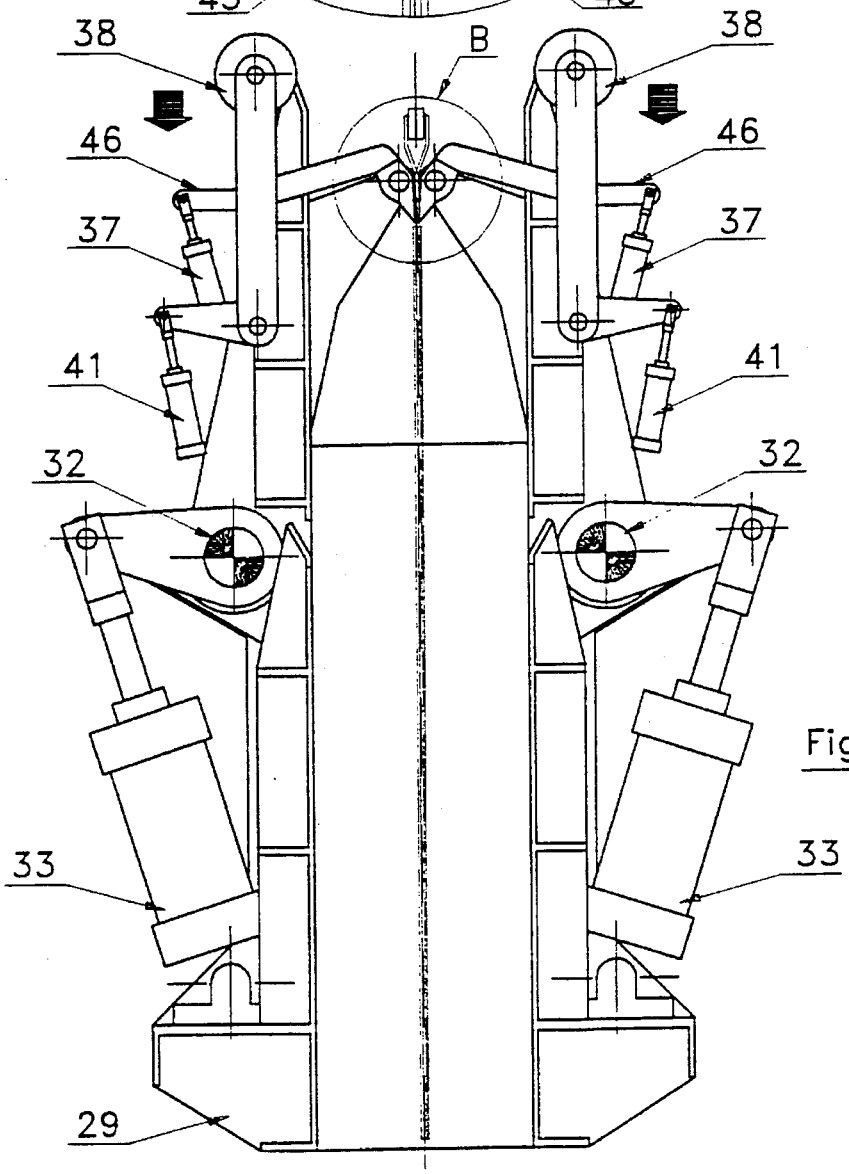
FIG. 11 is a sectional view similar to FIG. 10, with the extraction claws positioned to initiate the process.

From the position shown in FIGS. 11 and 12, the bracket 29 initiates a lowering movement, with the rollers 36 turning freely in contact with the plate of the cathode 42 and, therefore, maintaining the relative position of the claws 35 in respect to the cathode 42.

Figure 13:
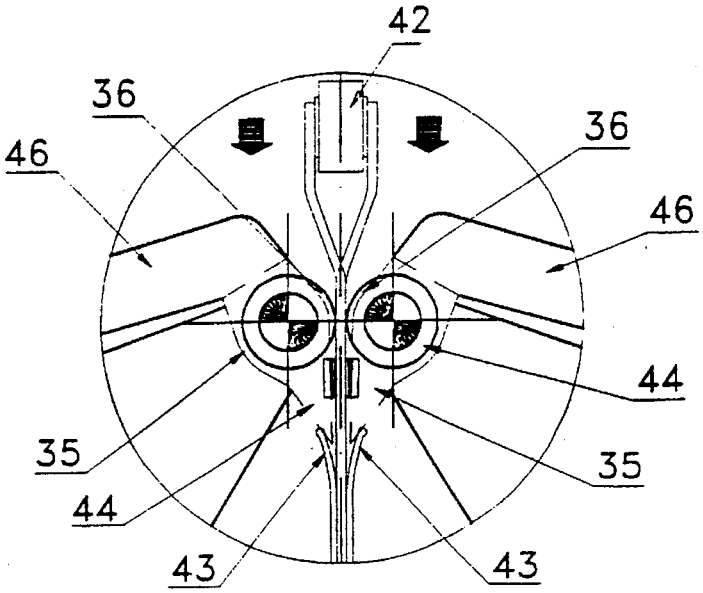
FIG. 13, 14 and 15 are views similar to that of FIG. 11, showing the claws at successive extraction process stages.

FIG. 13 shows the beginning of the lowering of the bracket 29. At this stage, the angled edge of the wedge shaped section 44 contact the upper edge of the electro-deposited layer 43, causing a penetration by the angled edge and the initial separation of the electro-deposited layer 43. All of this operation is shown in FIG. 13.

Figure 14:
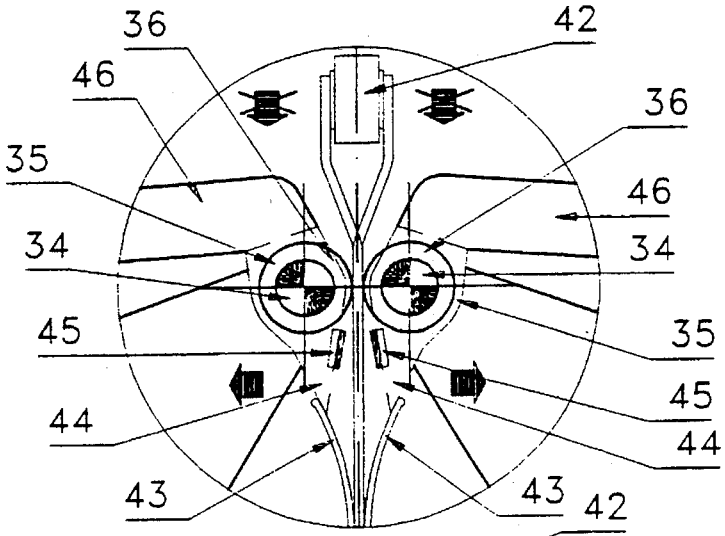
Figure 15:
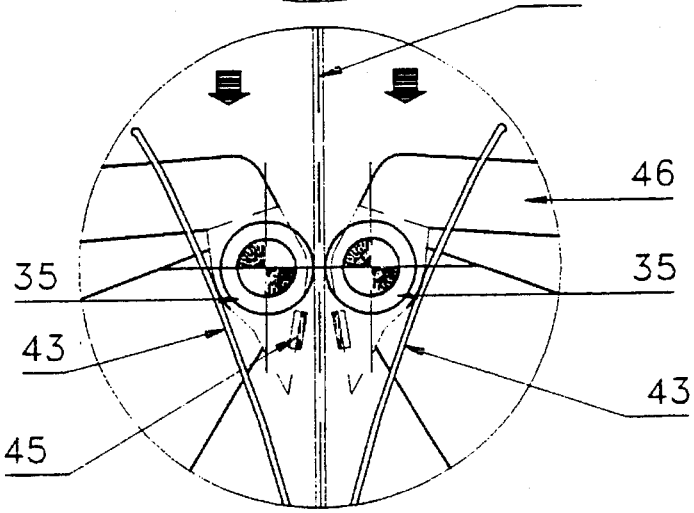
Figure 17:
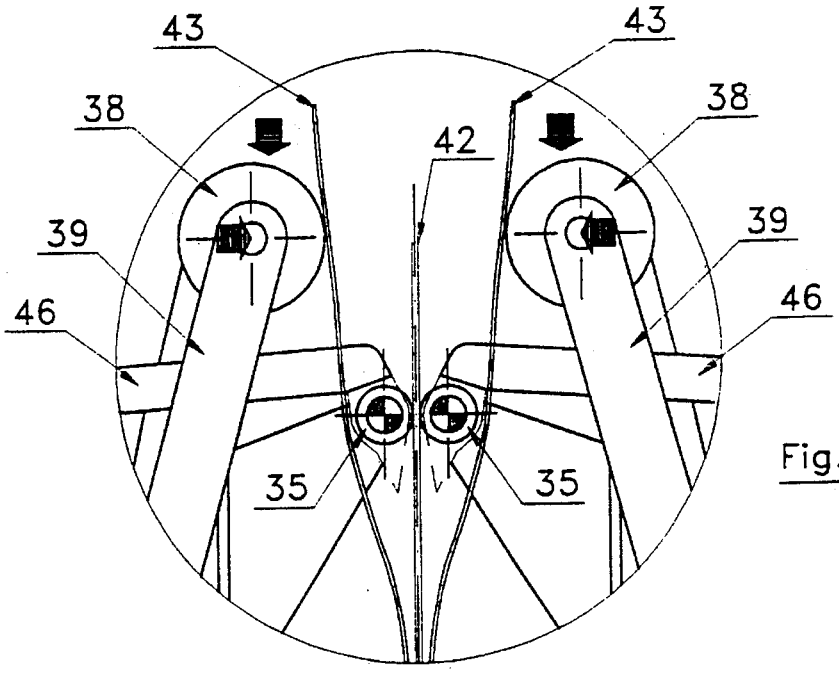
FIG. 17 is an enlarged view of detail C of FIG. 16.

During this separation step, the actuation of the hydraulic cylinders 37 (FIG. 11) causes the turning of the claws 35, which thereby separates the layer 43 from the cathode 42 and further causing the final separation of the upper portion of the layers 43. This stage of the operation is shown in FIG. 14. The continuous turning of the rollers 36 upon the cathode plate and the continuous separation of the electro-deposited layer 42 is shown in FIG. 15.

Figure 16:
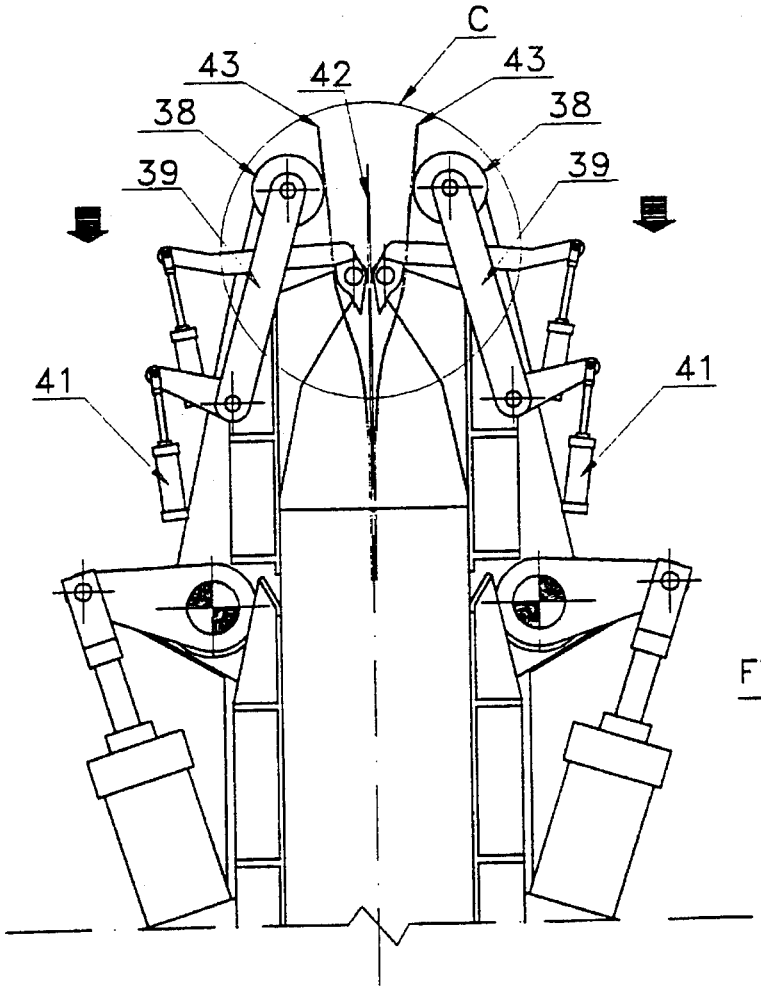
FIG. 16 is a view similar to that of FIG. 10, with the extraction elements at an intermediate process stage.

As the electro-deposited layer 43 separated from the cathode 42 moves up above the bracket 29, cylinders 41 are activated (FIG. 16) causing a tilting of the arms 39 towards their converging position. At this point, the free turning rollers 38 mounted at the end of arms 39 support the portion of the electro-deposited layers 43 that has been separated, and brings them closer towards the plate of the cathode 42.

Figure 18A:
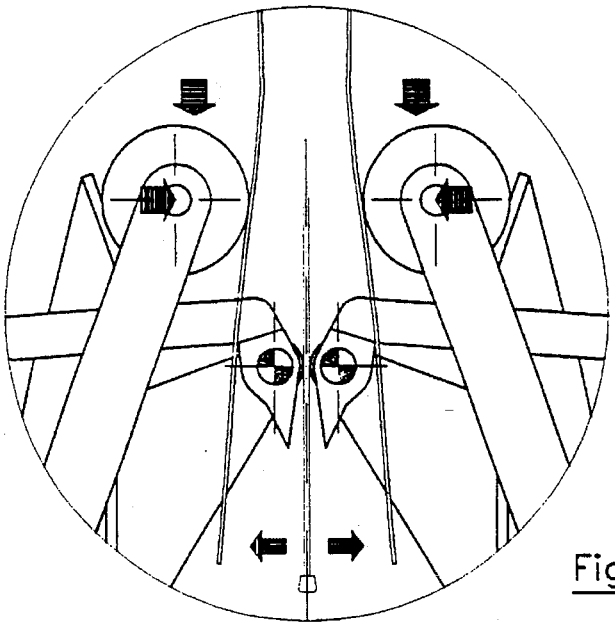
FIG. 18A is the circled portion of FIG. 18 enlarged.
Figure 18:
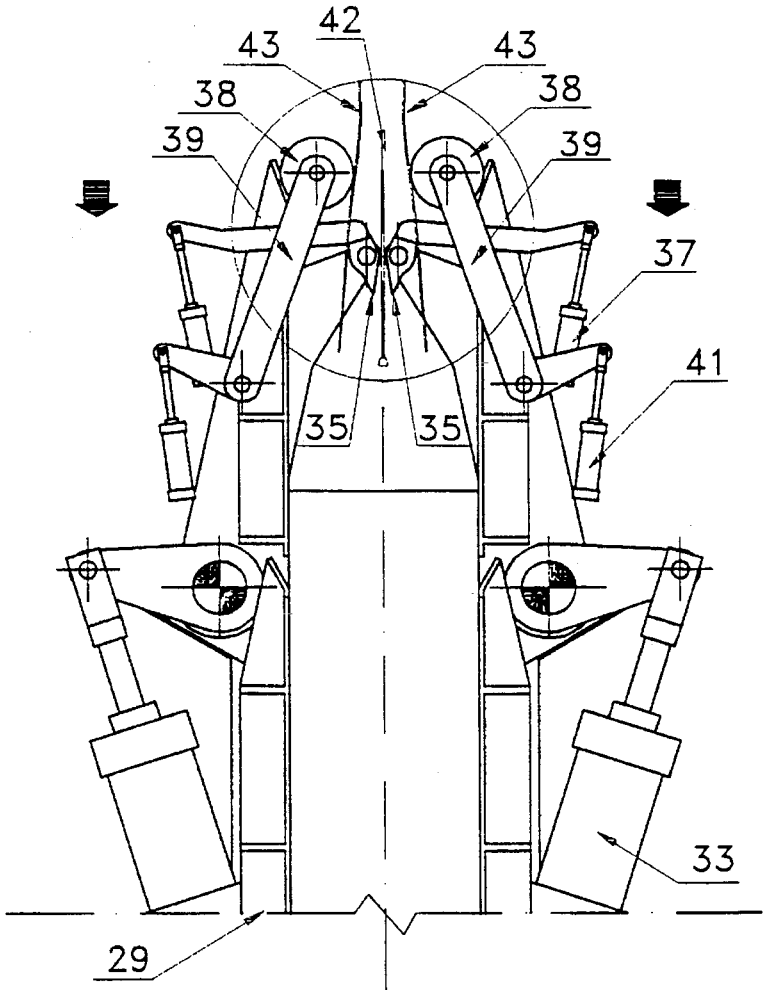
FIG. 18 is a view similar to FIG. 10, showing the final stage of the extraction process.
Figure 19:
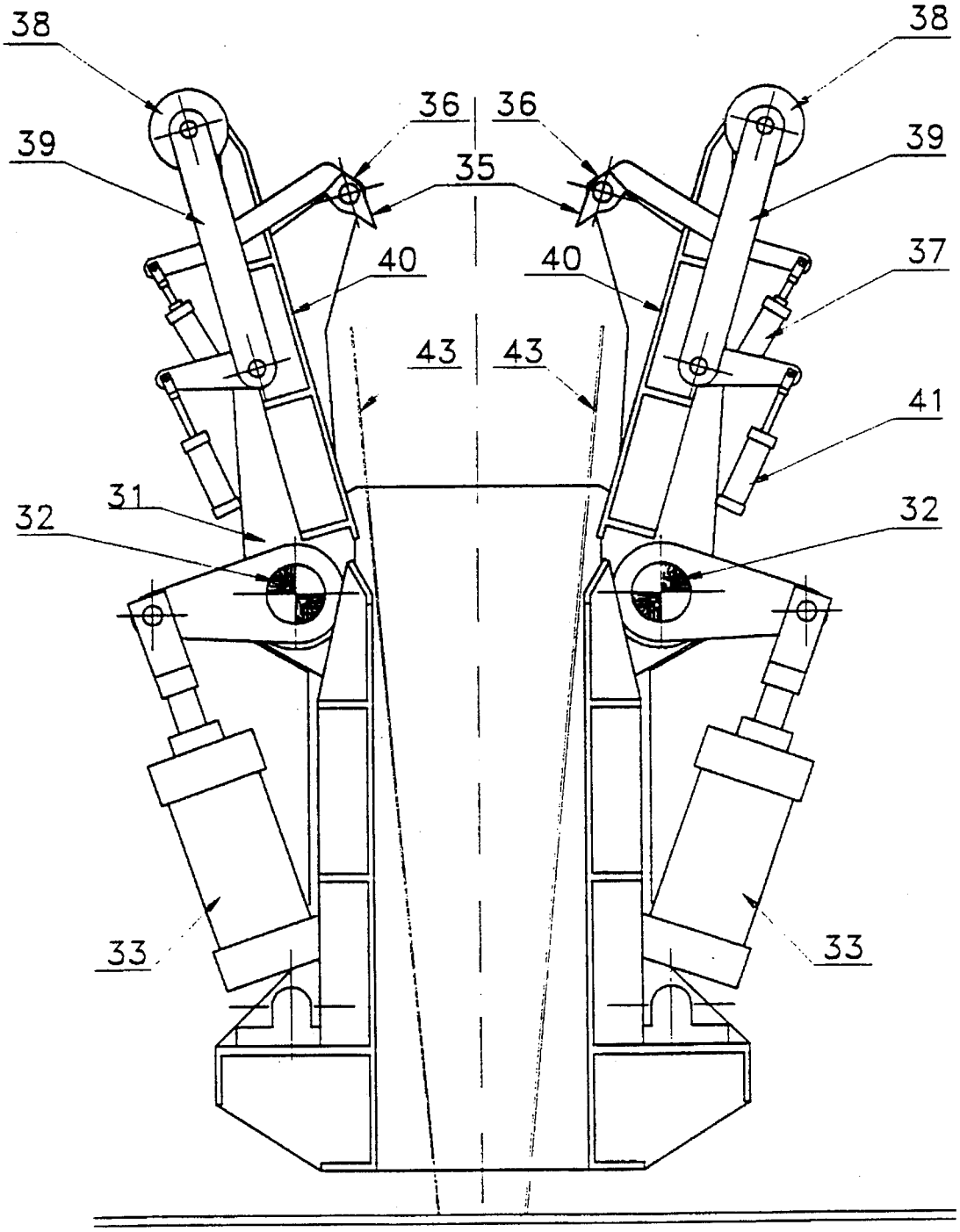
FIG. 19 is a view similar to FIG. 10, showing the position taken by a different extraction apparatus, once the process has ended.

Referring the FIG. 18, the various cylinders maintain their above-described position and the bracket 29 continues to lower, resulting in the complete separation of the electro-deposited layer 43 from the cathode plate 42. In the position shown in FIG. 18, a certain torque is caused between the free turning rollers 38 and the claws 35, Which tends to peel off the lower portion of the electro-deposited layers 43, without the necessity for the claws 35 and rollers 36 to reach the lower edge of the cathode 42. At the same time, the layers 43 separated from the cathode 42 are held between the rollers 38 and the claws 35.

The adoption of the above-described procedure eliminates the risk of damaging the protection of the lower edge of the cathode 32, since neither the claws 35 nor the rollers 38 contact this protection. The torque created between the free turning rollers 38 and the claws 35 prevents the lower edge of the peeled layers from colliding with the protection of the lower edge of the cathodes. Thus, it prevents any action that may damage the lower protection of the cathode plate.

On the other hand, the claws 35 do not contact directly the cathode plate 42, thus preventing any metal to metal contact that may damage the surfaces of the cathode plate 42.

Once the electro-deposited layers 43 have been completely separated and as the lowering movement of the bracket 29 ends, the cylinders 33 are retracted, which cause an outward tilt of the arms 31 and panels 40, as shown in the FIG. 18, thus preventing the collision between the free turning rollers 36 and the protection of the lower edge of the cathodes 42. The retraction of the cylinders 37 and 41 next takes place, freeing the electro-deposited layers 43 which fall through the bracket onto the dampening mechanism of the receiving conveyor belt 17 (FIG. 1).

Upon ending this stage, all the cylinders are then retracted and the bracket 29 is placed at its lower position, ready to start a new extraction cycle.

In the facility of the present invention, the cathodes are subject to a washing operation at the cathode reception area 1, and the electro-deposited metal layers on the cathodes are taken off by a continuous extraction process using the claws 35. In addition, the facility of the present invention prevents any damage to the cathode plate 42, because of the free turning rollers 36 which are mounted on the same turning axis as the claws 35, and because of the plastic protection devices 45 that is disposed oh the claws 35.

The modular construction of the facility described allows the arrangement, as required, of two or more treatment areas, each one of them with their corresponding washing and extraction means.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A facility for removing electro-deposited layers from cathodes the facility, having a reception area for the reception of cathodes, a cathode treatment area, and a cathode storage area for cathodes from which the electro-deposited layers have been removed, the cathode treatment area having a cathode washing apparatus and an electro-deposited layer extraction apparatus, the extraction apparatus comprising:

a bracket;

two sets of claws and two parallel rollers with each set of claws and each roller being coaxially mounted;and rotatable on two horizontal parallel bars;

the bars are connected to arms which are articulated at their lower end to the bracket, the arms are adapted to move between a maximum bar approximation position and separation position;

the bracket having a passageway between the horizontal parallel bars for receiving cathodes and is capable of vertical movement between a lower position at which it is positioned below the lower edge of a cathode received at the extraction apparatus, and an upper position at which the bracket contacts the cathode and the claws being located immediately above the upper edge of electro-deposited layer on the cathode;

the claws have a wedge shaped section with an internal surface, and the claws being adapted to rotate between a cathode approximation position at which the internal surface of the wedge shaped section is parallel to a cathode received in the bracket, and a separation position at which the internal surface rotates from the cathode, the internal surface of the wedge shaped section of the claws being near the cathode when the bracket is at an upper limiting position, which occurs when the arms tilt towards the maximum bar approximation position and the claws tilt towards the cathode approximation position.

2. The facility according to claim 1, wherein each of the parallel rollers is positioned between and coaxial to the two parallel bars and a set of claws, the rollers adapted to support a cathode when the bracket is positioned at an upper limiting position and the arms are at the maximum bar approximation position.

3. The facility according to claim 1, the cathode washing apparatus comprising:

a washing chamber open at its top and capable of vertical movement between two limiting positions, at a lower limiting position the washing chamber is below a cathode receive in the treatment area and suspended therein, and at an upper limiting position the washing chamber is at the suspended cathode in the treatment area, the washing chamber having at least one row of constant pressure spray nozzles on each of opposed walls of the chamber.

4. The facility according to claim 1, the extraction apparatus further comprising:

two upper rollers, parallel to the rollers mounted on the parallel bars and located above the claws, the upper rollers are mounted so that they freely turn between pairs of arms articulated at their lower edge to the extraction unit bracket and connected to external actuating cylinders, the articulated arms capable of tilting between two limiting positions, a vertical limiting position in Which the upper rollers are located outside the bracket passageway, and a converging limiting position in which the upper rollers are located towards the inside of the bracket passageway.

5. The facility according to claim 1, within the washing chamber apparatus and the extraction bracket apparatus are mounted upon two consecutively positioned gantries in the facility.

6. The facility according to claim 1, further comprising a protection device disposed at the internal surface of the wedge shaped section of each claw, the protection device adapted to rest against a cathode being treated.

7. The facility according to claim 6, wherein the protection device is of plastic.

8. A facility for removing electro-deposited layers on a cathode, comprising:

a reception area for receiving cathodes having electro-deposited layers;

a treatment area for removing the electro-deposited layers from the cathodes, the treatment area having a washing apparatus for washing the cathodes prior to removal of the electro-deposited layers, and an extraction apparatus for removing the electro-deposited layer from the cathodes;

a storage area for storing cathodes which have had the electro-deposited layer removed; and a first gantry, wherein the washing apparatus is moveable and guided along the first gantry.

9. The facility according to claim 8, wherein the facility is integrated by means for transporting the cathodes between the reception, treatment, and storage areas.

10. The facility according to claim 8, further comprising:

a second gantry, wherein the extraction apparatus is moveable and guided along the second gantry.

11. An apparatus for extracting electro-deposited layers from a cathode, comprising:

a bracket for housing the extracting apparatus;

claws for separating the electro-deposited layers from the cathode, the claws having a wedged shaped section adapted for engaging the electro-deposited layers;

a roller coaxially positioned with respect to the claws, the roller and the claws carried on the bracket, the roller adapted for being positioned on the cathode and thereby positioning the claws with respect to the cathode.

12. The apparatus according the claim 11, wherein the wedge shaped section of each claw has an angled edge which is capable of separating the electro-deposited layer from the cathode, and the wedge shaped section has an internal surface adapted to oppose a surface of the cathode.

13. The apparatus according to claim 12, further comprising:

a protective device disposed at the internal surface of the claw and extending therefrom, the protective device adapted to separate the internal surface of the claw from the cathode during the extraction process, thereby to prevent contact between the claw and the cathode.

14. The apparatus according to claim 13, wherein the protective device is plastic.

15. The apparatus according to claim 12, further comprising:

an upper roller carried on the bracket and adapted during the extraction process to be positioned above the claws and the roller coaxial with the claw, the upper roller is further adopted during the extraction process to engage the electro-deposited layer separated from the cathode such that a torque results between the upper roller and the claw which assists in the removal of the electro-deposited layer from the cathode.

16. The apparatus according to claim 11, further comprising:

means for tilting the claws, and means for turning the roller.

17. The apparatus according to claim 16, wherein the means for tilting and the means for turning are hydraulic/pneumatic cylinders.

18. The apparatus according to claim 11, wherein the claws arena first set of two spaced-apart claws, and the roller is a first roller positioned between the two claws.

19. The apparatus according to claim 11, further comprising:

a second set of two spaced-apart claws and a second roller positioned between the second set of two spaced-apart claws; and the second set of claws and the second roller are disposed opposite the first set of claws and the first roller on the bracket.

20. An apparatus for washing cathodes with electro-deposited layers thereon, comprising:

a chamber having an opening at a top surface thereof to receive and house a cathode and having walls;

a plurality of spray nozzle disposed internally on at least one wall of the chamber, the spray nozzles adapted for dispensing a washing fluent on a cathode received in the chamber a plurality of flexible sheets covering the opening of the chamber, said flexible sheets adapted to permit the entrance and exit of a cathode from the chamber but prevent the exit of the fluid from the chamber; and a plurality of flexible sheets covering the opening of the chamber, the flexible sheets adapted to permit the entrance and exit of a cathode from the chamber but prevent the exit of the fluid from the chamber.

* * * * *